US007658598B2

(12) United States Patent
Reed et al.

(10) Patent No.: US 7,658,598 B2
(45) Date of Patent: Feb. 9, 2010

(54) METHOD AND CONTROL SYSTEM FOR A PUMP

(75) Inventors: David A. Reed, Greenfield, IN (US); Timothy D. Hogue, Indianapolis, IN (US)

(73) Assignee: Proportionair, Incorporated, McCordsville, IN (US)

( * ) Notice: Subject to any disclaimer, the term of this patent is extended or adjusted under 35 U.S.C. 154(b) by 0 days.

(21) Appl. No.: 11/257,333

(22) Filed: Oct. 24, 2005

(65) Prior Publication Data

US 2007/0092386 A1 Apr. 26, 2007

(51) Int. Cl.
*F04B 49/00* (2006.01)
*F04B 43/06* (2006.01)

(52) U.S. Cl. ..... 417/395; 417/46

(58) Field of Classification Search ..... 417/393–395, 417/46, 386, 388

See application file for complete search history.

(56) References Cited

U.S. PATENT DOCUMENTS

| | | | | |
|---|---|---|---|---|
| 3,782,863 | A | | 1/1974 | Rupp |
| 3,838,946 | A | | 10/1974 | Schall |
| 4,111,226 | A | | 9/1978 | Cameron |
| 4,238,992 | A | | 12/1980 | Tuck, Jr. |
| 4,242,941 | A | | 1/1981 | Wilden et al. |
| 4,247,264 | A | | 1/1981 | Wilden |
| 4,270,441 | A | | 6/1981 | Tuck, Jr. |
| 4,339,985 | A | | 7/1982 | Wilden |
| 4,406,596 | A | | 9/1983 | Budde |
| 4,422,835 | A | | 12/1983 | McKee |
| 4,465,102 | A | | 8/1984 | Rupp |
| 4,472,115 | A | | 9/1984 | Rupp |
| D275,858 | S | | 10/1984 | Wilden |
| 4,478,560 | A | | 10/1984 | Rupp |
| 4,549,467 | A | | 10/1985 | Wilden et al. |
| D294,946 | S | | 3/1988 | Wilden |
| D294,947 | S | | 3/1988 | Wilden |
| 4,856,969 | A | | 8/1989 | Forsythe et al. |
| 4,901,758 | A | | 2/1990 | Cook et al. |
| 5,165,869 | A | | 11/1992 | Reynolds |
| D331,412 | S | | 12/1992 | Wilden |
| 5,174,731 | A | | 12/1992 | Korver |
| 5,257,914 | A | | 11/1993 | Reynolds |
| 5,262,068 | A | * | 11/1993 | Bowers et al. ..... 210/767 |
| 5,281,107 | A | * | 1/1994 | De Koning ..... 417/386 |
| 5,332,372 | A | | 7/1994 | Reynolds |
| 5,362,212 | A | | 11/1994 | Bowen et al. |
| 5,375,625 | A | | 12/1994 | Reynolds |
| 5,378,122 | A | | 1/1995 | Duncan |
| 5,415,528 | A | * | 5/1995 | Ogden et al. ..... 417/28 |
| 5,421,208 | A | * | 6/1995 | Packard et al. ..... 73/861 |
| 5,441,281 | A | | 8/1995 | Baland |
| 5,538,042 | A | | 7/1996 | Baland |
| 5,607,290 | A | | 3/1997 | Duncan |
| 5,611,678 | A | | 3/1997 | Pascual |

(Continued)

OTHER PUBLICATIONS

David Hollen, Engineering Handbook for Air-Powered Double Diaphragm Pumps, date unknown, Yamada America, Inc., West Chicago, Illinois.

(Continued)

*Primary Examiner*—Charles G Freay
(74) *Attorney, Agent, or Firm*—Baker & Daniels LLP

(57) ABSTRACT

The present invention includes methods and apparatuses for operating and controlling AOD pumps.

31 Claims, 6 Drawing Sheets

U.S. PATENT DOCUMENTS

| | | | | | |
|---|---|---|---|---|---|
| 5,619,786 | A | | 4/1997 | Baland | |
| 5,628,229 | A | | 5/1997 | Krone et al. | |
| 5,724,881 | A | | 3/1998 | Reynolds | |
| 5,743,170 | A | | 4/1998 | Pascual et al. | |
| D400,210 | S | | 10/1998 | Reynolds et al. | |
| 5,816,778 | A | | 10/1998 | Elsey, Jr. et al. | |
| 5,819,792 | A | | 10/1998 | Reynolds | |
| 5,851,109 | A | | 12/1998 | Reynolds | |
| 5,927,954 | A | | 7/1999 | Kennedy et al. | |
| 5,950,523 | A | | 9/1999 | Reynolds | |
| 5,957,670 | A | | 9/1999 | Duncan et al. | |
| 5,996,422 | A | | 12/1999 | Buck et al. | |
| 5,996,627 | A | | 12/1999 | Reynolds | |
| 6,004,105 | A | | 12/1999 | Reynolds | |
| 6,036,445 | A | | 3/2000 | Reynolds | |
| D426,553 | S | | 6/2000 | Jack et al. | |
| 6,102,363 | A | | 8/2000 | Eberwein | |
| 6,126,403 | A | * | 10/2000 | Yamada | 417/46 |
| 6,129,525 | A | | 10/2000 | Reynolds | |
| 6,142,749 | A | | 11/2000 | Jack et al. | |
| 6,152,705 | A | | 11/2000 | Kennedy et al. | |
| 6,158,966 | A | * | 12/2000 | Guespin et al. | 417/46 |
| 6,158,982 | A | | 12/2000 | Kennedy et al. | |
| D435,855 | S | | 1/2001 | Donelson et al. | |
| 6,168,387 | B1 | | 1/2001 | Abel et al. | |
| 6,168,394 | B1 | | 1/2001 | Forman et al. | |
| 6,241,487 | B1 | * | 6/2001 | Reynolds | 417/395 |
| 6,257,845 | B1 | | 7/2001 | Jack et al. | |
| 6,280,149 | B1 | | 8/2001 | Abel et al. | |
| 6,357,723 | B2 | | 3/2002 | Kennedy et al. | |
| 6,435,845 | B1 | | 8/2002 | Kennedy et al. | |
| 6,554,578 | B1 | * | 4/2003 | Siegel | 417/53 |
| 6,561,774 | B2 | | 5/2003 | Layman | |
| 6,582,205 | B2 | * | 6/2003 | Batten et al. | 417/393 |
| RE38,239 | E | | 8/2003 | Duncan | |
| 6,604,909 | B2 | | 8/2003 | Schoenmeyr | |
| 6,619,932 | B2 | | 9/2003 | Murata | |
| 6,623,245 | B2 | | 9/2003 | Meza et al. | |
| 6,644,930 | B1 | | 11/2003 | Kuismanen | |
| 6,685,443 | B2 | | 2/2004 | Simmons et al. | |
| 6,752,599 | B2 | * | 6/2004 | Park | 417/46 |
| 6,767,189 | B2 | | 7/2004 | Kleibrink | |
| 6,829,542 | B1 | | 12/2004 | Reynolds et al. | |
| 6,962,175 | B2 | | 11/2005 | Viken | |
| 6,988,508 | B2 | | 1/2006 | Bauer et al. | |
| 7,021,909 | B1 | | 4/2006 | Steck | |
| 7,082,750 | B2 | * | 8/2006 | Knight | 60/259 |

OTHER PUBLICATIONS

Ingersoll-Rand, Pumps and Products of Industrial Assembly, Catalog, 2001, Bryan, Ohio, http://www.irtools.com/ARO/lit/downloads/INDASSM.pdf.

Ingersoll-Rand, Pumps and Accessories for the Process Industries, Catalog, 2000, Bryan, Ohio, http://www.irtools.com/ARO/lit/downloads/9910-P.pdf.

Trebor, Model 110E Pump, Operation/Maintenance Manual, Jan. 2002, West Jordan, Utah, http://www.treborintl.com/custserv/manuals/Pumps%20&%20Surges/110/M110E-ac.pdf.

Trebor, PC5 Oscillator, Operation/Maintenance Manual, Mar. 2000, West Jordan, Utah, http://www.treborintl.com/custserv/manuals/Other/PC5/MPC5-ba.pdf.

Trebor, PC6 Oscillator, Operation/Maintenance Manual, Mar. 2000, West Jordan, Utah, http://www.treborintl.com/custserv/manuals/Other/PC6/MPC6-aa.pdf.

Trebor, PC10 Oscillator, Operation/Maintenance Manual, Jan. 2000, West Jordan, Utah, http://www.treborintl.com/custserv/manuals/Other/PC10/MPC10-aa.pdf.

Trebor, PC201 Pump Controller, Operation/Maintenance Manual, Aug. 2000, West Jordan, Utah, http://www.treborintl.com/custserv/manuals/Other/PC20/MPC20i-aa.pdf.

Trebor, Maxim External Control Pump Interface to a PLC Manual, Apr. 1999, West Jordan, Utah, http://www.treborintl.com/custserv/manuals/Other/PLC_Interface .pdf.

Trebor, Maxim External Control Pump Interfact to IWAKI AC1 Controller Manual, Apr. 1999, West Jordan, Utah, http://www.treborintl.com/custserv/manuals/Other/Iwaki_AC1_CI .pdf.

Trebor, Maxim External Control Pump Interfact to IWAKI AC3 Controller Manual, Apr. 1999, West Jordan, Utah, http://www.treborintl.com/custserv/manuals/Other/Iwaki_AC3_CI.pdf.

Trebor, M20 Pump Monitor, Operation/Maintenance Manual, Feb. 2001, West Jordan, Utah, http://www.treborintl.com/custserv/manuals/Other/M20/M20-ca.pdf.

Warren Rupp, Sandpiper Sandpiper II, Principles of Operation, 2002, Mansfield, Ohio, http://www.warrenrupp.com/prin-of-op.html.

Warren Rupp, Sandpiper Sandpiper II, Principles of Operation, Rupp Guard Spill Prevention 2002, Mansfield, Ohio http://www.warrenrupp.com/install-guide.html.

Warren Rupp, Guaranteed Non-Stalling Air Valve Performance, Oct. 2000, Mansfield, Ohio, http://www.warrenrupp.com/pdf/no-stall-guarantee-flyer.pdf.

Wilden Pump & Engineering Co., Principles of Operation, date unknown http://www.wildenpump.com/techinfo/operation.cfm.

Wilden Pump & Engineering Co., How to Read a Wilden Flow Curve, date unknown http://www.wildenpump.com/techinfo/read.cfm.

Wilden Pump & Engineering Co., Pump User's Guide, Jun. 2002, Grand Terrace, California http://www.wildenpump.com/pugs/ENGLISH_PUG.pdf.

Yamada America, Inc., Air Valve Technology, 2006 http://www.yamadapump.com/air_valve/air_valve.html.

Yamada America, Inc., Yamada Pumps-Engineered for Performance. Designed for Life, 2006 http://www.yamadapump.com/advantage/advantage_yamada.html.

Yamada America, Inc., Ten Intelligent Reasons to Specify a Yamada Air-Powered Double Diaphragm Pump, 2006 http://www.yamadapump.com/advantage/ten_reasons.html.

Yamada America, Inc., Pump Controller Specifications, 2006 http://www.yamadapump.com/specialty/specs_controller.html.

Proportion-Air, Diagram of QB1 Servor Controlling PSR in Response to Signal from DSTY.

Accessories Brochure <http://www.warrenrupp.com/pdf/ACCESSORIES%20BROCHURE.pdf?CategoryID=12> entitled "Discover the Sandpiper Solutions: Accessories & Controls" Warren Rupp, Inc., 2004.

Service and Operating Manual <http://www.warrenrupp.com/svc-man/RuppTech-POKits%20for%20SPJI520%26%20MII%20svc%20man.pdf?CategoryID=12> entitled RuppTech® Pulse Output Kits for SandPIPER II® and MARATHON II® Pumps by Warren Rupp, Inc., 2002.

Service and Operating Manual <http://www.warrenrupp.com/svc-man/s20%20SMetallic%20svc%20man.pdf> entitled "Sandpiper® Model S20 Metallic Design Level 1" by Warren Rupp, Inc., 2004.

Service and Operating Manual <http://www.warrenrupp.com/svc-man/s30%20SMetallic%20svc%20man.pdf> entitled Sandpiper® Model S30 Metallic Design Level 1" by Warren Rupp, Inc., 2004.

Webpage <http://www.diaphragmpumps.co.uk/Batch.php> entitled "Batch Controllers and Stroke Counters" by Diaphragm Pumps, Ltd., 2004.

Webpage <http://www.wildenpurnp.com/techinfo/p-flov.cfm> entitled "Pro-Flo V Technology" by Wilden Pump & Engineering Company, date unknown.

* cited by examiner

METHOD AND CONTROL SYSTEM FOR A PUMP

BACKGROUND OF THE INVENTION

The present invention relates generally to a pump. More particularly, the present invention relates to a control system for a pump.

BACKGROUND AND SUMMARY

Pumps are used in the sanitation, industrial, and medical fields to pump liquids or slurries. In air operated diaphragm pumps (AOD pumps), flexible diaphragms generally exhibit excellent wear characteristics even when used to pump relatively harsh components such as concrete. Diaphragms pumps use the energy stored in compressed gases to move liquids. AOD pumps are particularly useful for pumping higher viscosity liquids or heterogeneous mixtures or slurries such as concrete. Compressed air is generally used to power AOD pumps in industrial settings.

According to one aspect of the present inventions, a pump is provided that includes first and second diaphragm chambers, a pressure sensor, and a controller. Each diaphragm chamber includes a diaphragm. The diaphragms are coupled together. The pressure sensor is positioned to detect a pressure in at least one of the first and second diaphragm chambers and to output a signal indicative thereof. The controller is configured to receive the signal from the pressure sensor and monitor a pressure to detect the position of at least one of the diaphragms.

According to another aspect of the present invention, another pump is provided including first and second diaphragm chambers, a pressure sensor, and a controller. Each diaphragm chamber includes a diaphragm. The diaphragms are coupled together and operate in a cycle having a plurality of stages including a designated stage. The pressure sensor is positioned to detect a pressure in at least one of the first and second diaphragm chambers and to output a signal indicative thereof. The controller is configured to receive the signal from the pressure sensor to detect when the cycle reaches the designated stage.

According to another aspect of the present invention, a pump is provided including a housing defining an interior region, a pump member positioned to move in the interior region to pump material, a pressure sensor, and a controller. The interior region of the housing has a substantially cyclical pressure profile. The pressure sensor is positioned to detect the pressure in the interior region and to output a signal indicative thereof. The controller receives the output signal and monitors the substantially cyclical pressure profile.

According to another aspect of the present invention, a pump is provided that includes a housing defining an interior region, a pump member positioned to move in the interior region in a cycle to pump material, a pressure sensor positioned to detect a pressure in the interior region and to output a signal indicative thereof, a controller that receives the output signal and detects at least one parameter of the cycle, and an air supply valve providing air to the interior region that is controlled by the controller based on detection of the at least one parameter.

Additional features of the present invention will become apparent to those skilled in the art upon consideration of the following detailed description of the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

Figure 1:
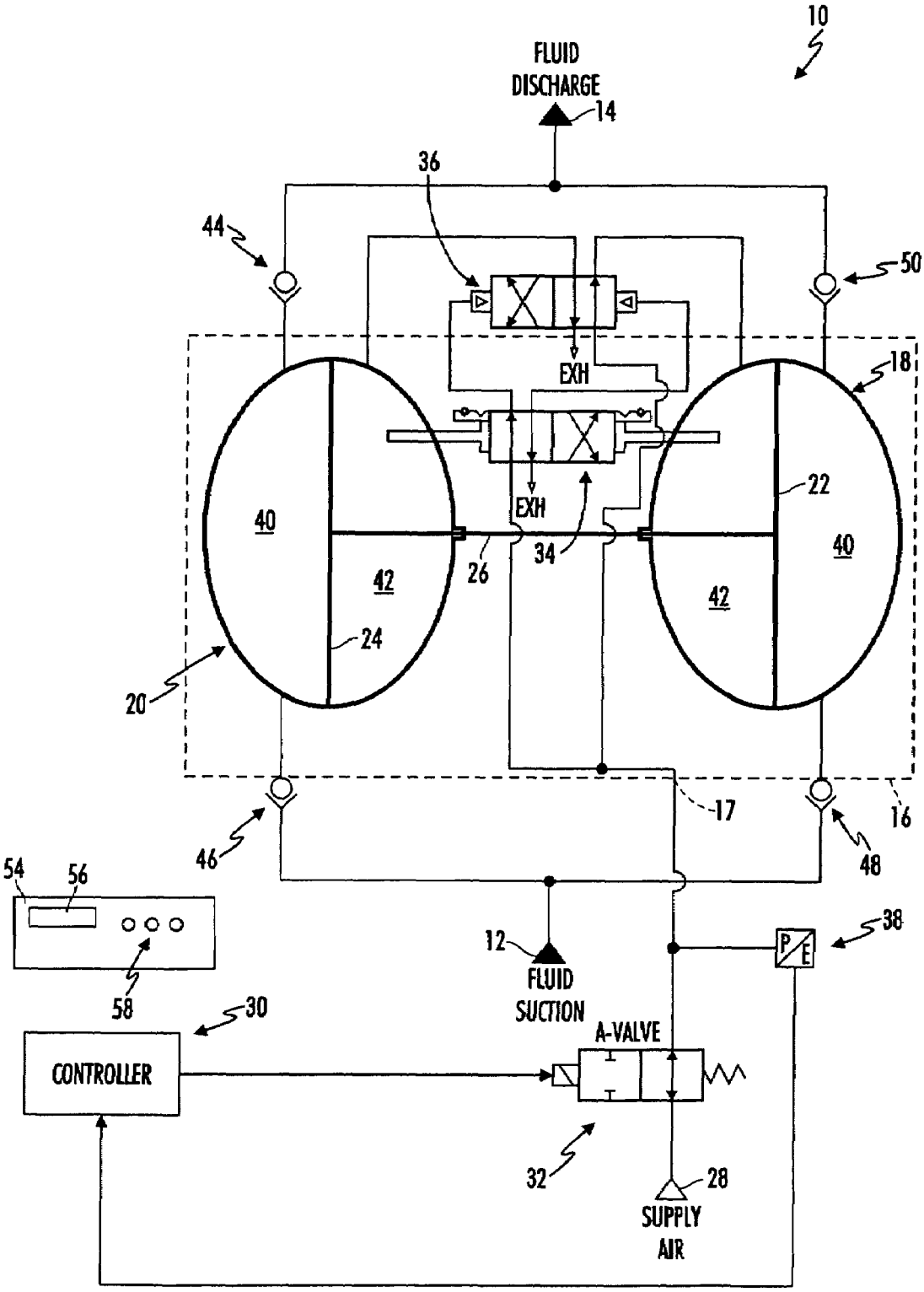
FIG. 1 is a schematic illustrating one embodiment of an AOD pump showing the pump, an air supply, a control valve immediately downstream of the air supply (or upstream from of the AOD pump), a pressure sensor immediately downstream of the control valve, and a controller coupled to the control valve and pressure sensor.

A pump 10 is shown in FIG. 1 for moving fluid, such as water or cement, from a first location 12 to a second location 14. Pump 10 includes a housing 16 defining first and second pump chambers 18, 20 and first and second diaphragms 22, 24 positioned in first and second pump chambers 18, 20 that are connected together by a connection rod 26. Pump 10 is powered by a compressed air supply 28. Air is provided to pump 10 through an inlet 17 into housing 16. The supply of pressurized air provided to pump chambers 18, 20 is controlled by a controller 30, supply valve 32, pilot valve 34, main valve 36, and pressure sensor 38.

Supply valve 32 is preferably a solenoid valve that is controlled by controller 30. Pilot valve 34 is controlled by the position of first and second diaphragms 22, 24. Main valve 36 is controlled by pilot air provided by pilot valve 34. According to alternative embodiments of the present disclosure, other valve configurations are provided including fewer or more solenoid valves, pilot valves, and air-piloted valves, and other valves and control arrangements known to those of ordinary skill in the art.

During operation, air supply 28 provides air to supply valve 32. Controller 30 sends an electronic signal to supply valve 32 to move between an open position (shown in FIG. 1) providing air to main valve 36 from supply valve 32 and a closed position (not shown) blocking air from supply valve 32.

Main valve 36 moves between a first position (shown in FIG. 1) providing pressurized air to first pump chamber 18 and a second position (not shown) providing pressurized air to second pump chamber 20. First and second diaphragms 22, 24 divide respective pump chambers 18, 20 into fluid and air sides 40, 42. When main valve 36 provides air to first pump chamber 18, the pressurized air provided by air supply 28 urges the driven side of first diaphragm 22 to the right and forces fluid out of fluid side 40. This fluid travels toward second location 14 up through a check valve 50 and is blocked from moving down toward first location 12 by another check valve 48.

During this movement of first diaphragm 22, rod 26 pulls second diaphragm 24 to the right. As second diaphragm 24 moves to the right, fluid side 40 of second pump chamber 20 expands and fluid is pulled up through a check valve 46 from first location 12. Another check valve 44 blocks fluid from second location 14 from being drawn into fluid side 40 of second pump chamber 20.

Near the end of the movement of second diaphragm 24 to the right, it strikes pilot valve 34 and urges it to the right as shown in FIG. 1. Pilot valve 34 then provides pressurized air to the port on the left side of main valve 36 to move it to the right from the position shown in FIG. 1. When main valve 36 moves to the right, it supplies pressurized air from air supply 28 to air side 42 of second pump chamber 20.

As air is provided to air side 42 of second pump chamber 20, the pressurized air pushes the driven side of second diaphragm 24 to the left and rod 26 pulls first diaphragm 22 to the left. Fluid in fluid side 40 of second chamber 20 is pushed up past check valve 44 toward second location 14 and blocked from moving down toward first location 12 by check valve 46. As the same time, fluid is drawn into fluid side 40 of first chamber 18 from first location 12 through check valve 48. Check valve 50 blocks fluid from being drawn from second location 14.

Near the end of the movement of first diaphragm 22 to the left, it strikes pilot valve 34 and urges it to the left (not shown). Pilot valve 34 then provides pressurized air to the port on the right side of main valve 36 to move it to the left as shown in FIG. 1. When main valve 36 moves to the left, it supplies pressurized air from air supply 28 to air side 42 of first pump chamber 18 to complete one cycle of pump 10. Additional details of the operation of pump 10 is provided in U.S. patent application Ser. No. 10/991,296, filed Nov. 17, 2004, titled Control System for An Air Operated Diaphragm Pump, to Reed et al., the disclosure of which is expressly incorporated by reference herein.

Figure 2:
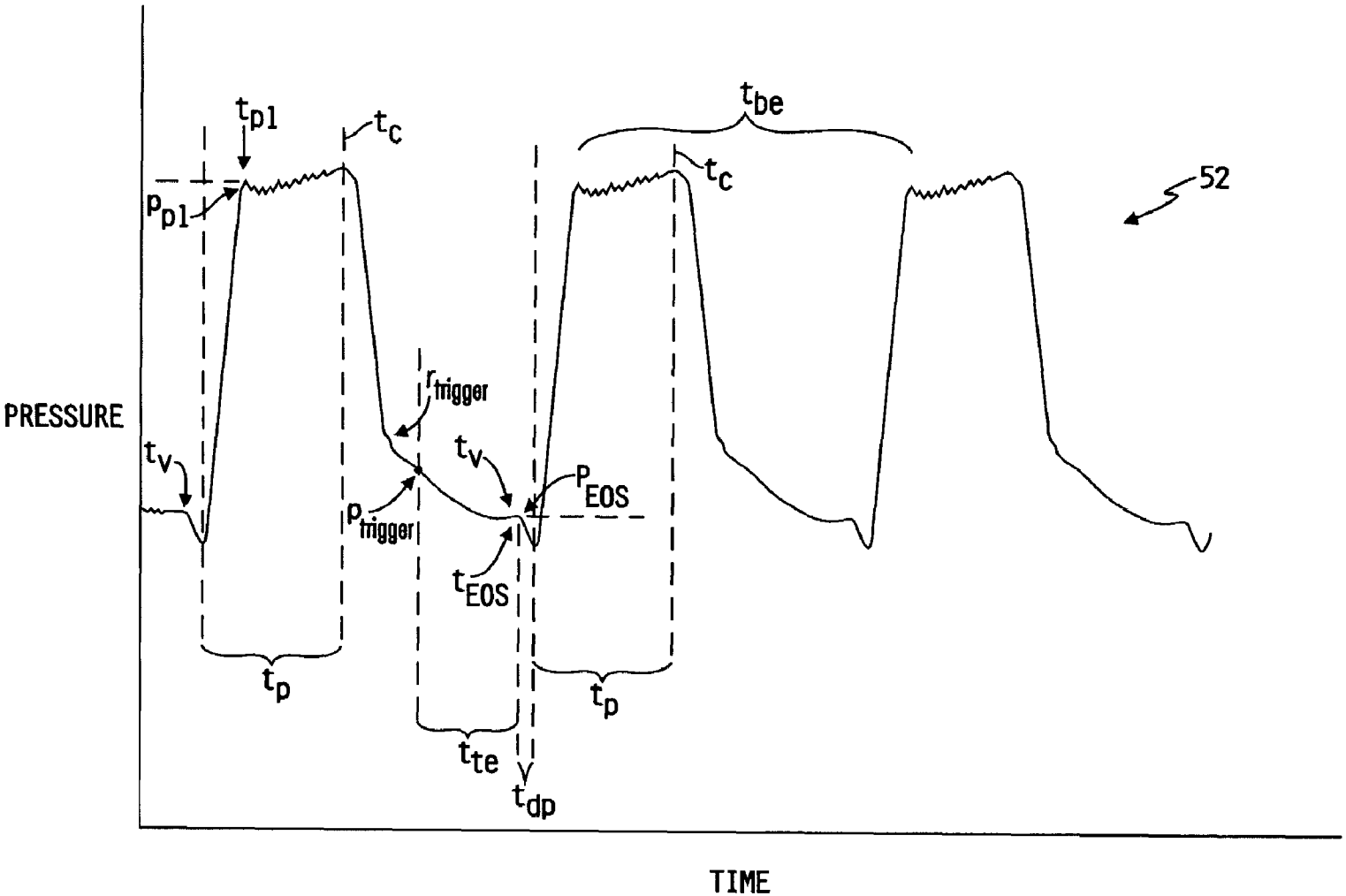
FIG. 2 is a graph of the pressure sensed by the pressure sensor during operation of the AOD pump according to one embodiment of the present disclosure.

According to one embodiment of the present disclosure, supply valve 32 controls how long pressurized air is provided to first and second chambers 18, 20 so that chambers 18, 20 are not always in fluid communication with air supply 28. When main valve 36 changes to the position shown in FIG. 1, it supplies air to air side 42 of first chamber 18 and vents air from air side 42 of second chamber 20. Supply valve 32 only provides air to main valve 36 for a predetermined amount of time ($t_p$) as shown in FIG. 2 until supply valve 32 closes at $t_c$. According to the current configuration of pump 10, $t_p$ is preferably between 100-500 ms depending on the operating conditions. According to alternative embodiments, other lesser or greater values of $t_p$ may be used, such 50 ms, 1000 ms, or other suitable times. After $t_c$, supply valve 32 closes and air supply 28 does not provide any more pressurized air. This operation also applies to second chamber 20 in the second half of the cycle.

FIG. 2 shows a pressure profile or curve 52 detected by pressure sensor 38. Pressure sensor 38 detects the increase in pressure in air side 42 of first chamber 18 in the first half of a cycle and air side 42 of second chamber 20 in the second half of the cycle. During $t_p$, the pressure on air side 42 of first chamber 18 increases from near atmosphere as shown in FIG. 2 to approximately the supply pressure. After $t_c$, the pressure on air side 42 of first chamber 18 begins to gradually decrease as first diaphragm 22 moves to the right and air side 42 of first chamber 18 expands.

The pressure on air side 42 of first chamber 18 continues to gradually decrease until second diaphragm 24 strikes pilot valve 34 and causes main valve 36 to move to the right as shown in FIG. 1. After main valve 36 moves to the right, pressure sensor 38 is then exposed to the pressure in air side 42 of second chamber 20. During the expansion of air side 42 of first chamber 18, air side 42 of second chamber 20 vents to nearly atmosphere. Thus, when main valve 36 moved at $t_v$, pressure sensor 38 is exposed to nearly atmosphere, which is significantly less than the pressure in air side 42 of first chamber 18 to which it was just exposed. This rapid decrease in pressure is shown in FIG. 2 at $t_v$, when main valve 36 moves to the right.

Controller 30 is configured to detect the rapid decrease in pressure sensed by pressure sensor 38. By detecting this decrease in pressure, controller 30 can determine that one of first and second diaphragms 22, 24 is at its end of stroke (EOS). When controller 30 detects the rapid pressure drop, it knows that main valve 36 has changed positions. Because main valve 36 only changes positions when one of first and second diaphragms 22, 24 is at its EOS, controller 30 knows that one of the first and second diaphragms 22, 24 is at its EOS. When the EOS is detected, controller 30 causes supply valve 32 to reopen for $t_p$. Pressure sensor 38 continues to measure the pressure on air side 42 of second chamber 20 until main valve 36 switches positions. Controller 30 again detects the rapid pressure change to detect EOS causing supply valve 32 to open for the next cycle. Illustratively, only one sensor 38 is provided for monitoring the pressure in first and second diaphragms 22, 24. According to an alternative embodiment, separate sensors are provided for each diaphragm.

Figure 3:
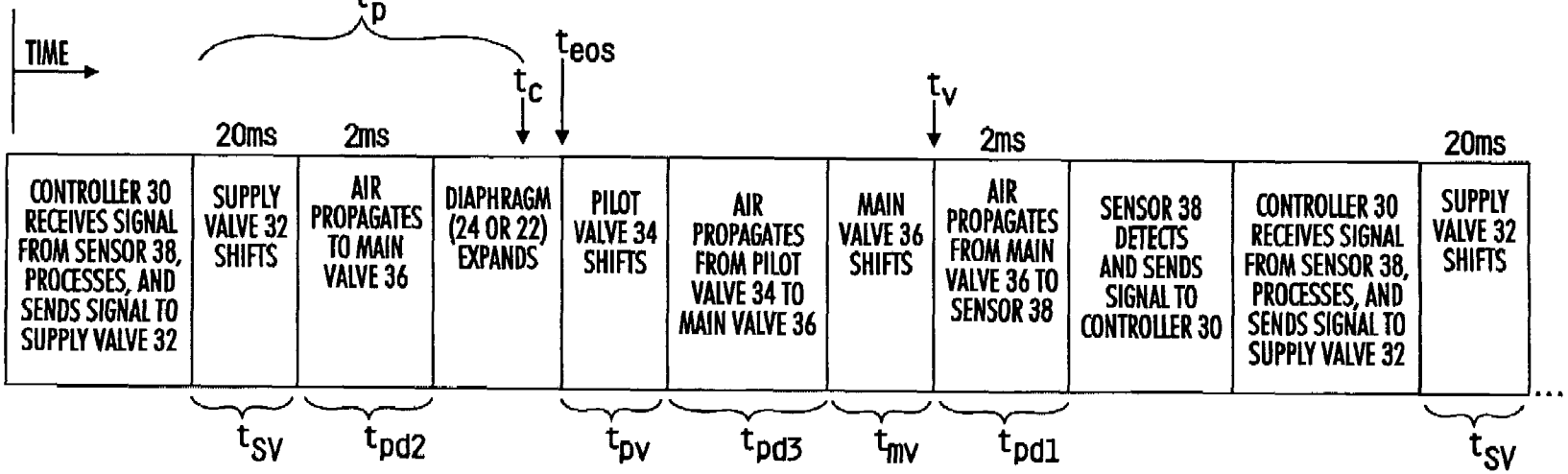
FIG. 3 is a diagram showing reaction or delay times between a diaphragm reaching a fully expanded position and pressurized air being supplied to the other diaphragm.

As shown in FIG. 2, a small delay occurs between $t_v$ and when supply valve 32 is reopened to pressurize air side 42 of second pump chamber 20. The components of pump 10 such as pilot valve 34, main valve 36, supply valve 32, and the other components of pump 10 have inherent reaction or delay times that slow down operation of pump 10. Some of the reaction or delay times between when diaphragm 22 (or 24) moves to the fully expanded position and the time pressurized air is provided to second diaphragm 24 (or 22) is shown in FIG. 3 (not to scale). Pilot valve 34 has a reaction time $t_{pv}$ between shifting between right to left positions. Similarly, main valve 36 has a reaction time $t_{mv}$ between receiving pilot pressure from pilot valve 34 and when it completely shifts to its new position. Solenoid supply valve 32 has a reaction time $t_{sv}$ between receiving a command from controller 30 and moving completely to the open position. Illustratively, supply valve 32 has an inherent response time of 20 ms. Other valves may have longer or shorter response times, such as 10, 40, or 90 ms.

Additional reaction time is required for air pressure to propagate or move through the conduits. For example, there is a delay time $t_{pd1}$ between when main valve 36 switches positions and air at near atmospheric pressure is provided to pressure sensor 38. Approximately the same delay time ($t_{pd1}$) occurs between main supply valve 32 and main valve 36 because sensor 38 is positioned so close to supply valve 32. Similarly, there is a delay time $t_{pd2}$ between when pressurized air is provided by supply valve 32 and the pressurized air reaches main valve 36. Similarly, there is an air propagation delay time $t_{pd3}$ between pilot valve 34 shifting and the air pressure reaching a respective port of main valve 36. According to one embodiment, the conduit propagation time is about 1 ms per foot of conduit. Assuming 2 feet of conduit exists between supply valve 32 (or sensor 38) and main valve 36, pump 10 has a propagation delay time $t_{pd1}$ of approximately 2 ms between supply valve 32 and main valve 36. Thus, the total delay between when controller 30 signals supply valve 32 to open and pressurized air is actually provided to main valve 36 is 22 ms. Depending on the selection of supply valve 32, the length of conduit, and other factors, such as the pilot pressure required to actuate main valve 36, the total delay may be longer or shorter. For example, according to other embodiments, the delay may about 10, 20, 30, 50, 60, 70, 80, 90, 100 ms or more.

According to one embodiment of the present disclosure, controller 30 compensates for the inherent reaction or delay times present in pump 10 to increase the operating speed of pump 10. Controller 30 commands the opening of supply valve 32 before the EOS occurs so that pressurized air is provided to the next-to-expand chamber 22 or 24 immediately, with little, if any delay. By compensating for the delay, controller 30 opens supply valve 32 sooner in the cycle to increase the pump speed.

To compensate for the delay, controller 30 triggers the opening of supply valve 32 based on the detection of a characteristic or parameter of pressure curve 52. This characteristic of pressure curve 52 becomes a timing trigger event on pressure curve 52 that indicates the operating position of pump 10 and its components. Once controller 30 observes the timing trigger event, it waits for an amount of wait time ($t_{wait}$), if any, to open supply valve 32. The length of $t_{wait}$ is calculated or selected by controller 30 or preprogrammed to reduce or eliminate the delay.

Figure 4:
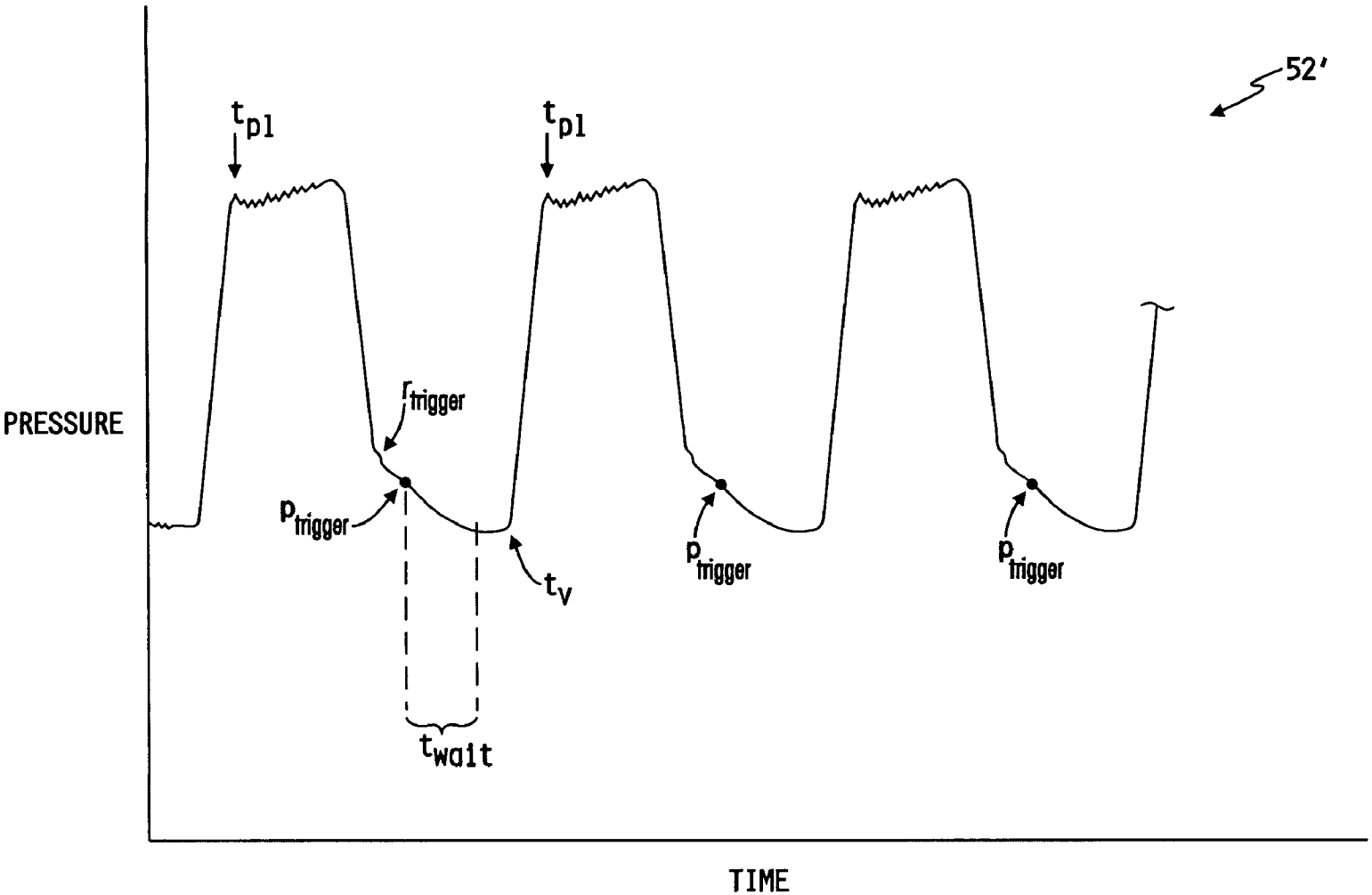
FIG. 4 is a graph of pressure sensed by the pressure sensor during operation of the AOD pump when inherent system delays are reduced or eliminated according to another embodiment of the present disclosure.

After controller 30 observes the timing trigger event, it waits for $t_{wait}$ to signal supply valve 32 to open. According to one embodiment, the timing trigger event is when the rate of decay of pressure slows to a predetermined amount such as at $r_{trigger}$ as shown in FIGS. 2 and 4. According to another embodiment, the trigger event is a predetermined threshold pressure such as the pressure at $p_{trigger}$. According to other embodiments, other characteristics of pressure curve 52 are used as trigger events. After controller 30 detects the trigger event (such as $r_{trigger}$ or $p_{trigger}$), it waits for $t_{wait}$ and then instructs supply valve 32 to open. According to alternative embodiments of the present disclosure, other sensors can be used to provide trigger events. According to one embodiment, a proximity sensor is provided that detects the actual physical position of pilot valve 34, rod 26, or either of both of diaphragms 20, 18 to sense a trigger event. According to other embodiments, the pressure is detected at other locations to detect a pressure derived trigger event. For example, according to one embodiment, pressure sensors are provided that detect the pressure in the pilot lines that provide pressure signals to main valve 36 indicating whether pilot valve 34 has changed positions.

To determine $t_{wait}$, controller 30 observes the amount of time ($t_{te}$) between the trigger event ($pt_{rigger}$ in FIG. 2) and when the EOS is observed as described above. According to one embodiment, this observation is made over one cycle of pump 10. According to another embodiment, this time is observed over several cycles and averaged. Controller 30 then subtracts an amount of total delay time ($t_{td}$) from $t_e$ to determine $t_{wait}$. This removes or reduces the inherent delay between when main valve 36 switches positions and when pressurized air is supplied to main valve 36.

Controller 30 determines the amount of time to subtract ($t_{dt}$) by detecting the amount of delay in pump 10. Because pressure sensor 38 is positioned relatively close to supply valve 32, the amount of delay due to operation of controller 30 and supply valve 32 is approximately equal to the time from EOS ($t_{EOS}$) until the pressure begins to rise again at $t_{dp}$. This time may be calculated by controller 30 or preprogrammed. Additional delay ($t_{pd1}$) is caused by air pressure propagation from main valve 36 to pressure sensor 38 just after main valve 36 switches position before $t_{EOS}$. Further delay ($t_{pd2}$) is caused by air pressure propagation from supply valve 32 to main valve 36 just after supply valve 32 opens. Illustratively, the air propagation delays ($t_{pd1}$ and $t_{pd2}$) are pre-programmed into controller 30. According to one embodiment of the present disclosure, the air propagation delays are determined based on the maximum pressure sensed in the pressure curve. If the pressure is high, the propagation delay is less than for lower pressure. When the length of conduit is known, the propagation delay can be determined based on the maximum pressure detected on the pressure curve. The propagation delays ($t_{pd1}$ and $t_{pd2}$) and supply valve delay ($t_{dp}$) are combined for $t_{td}$ and subtracted from $t_{te}$. Thus, $t_{wait}=t_{te}-t_{td}$. According to another embodiment, controller 30 gradually reduces $t_{te}$ (and thus $t_{wait}$) until the pump speed no longer increases and sets the reduced time as $t_{wait}$ and continues to use $t_{wait}$ for future cycles of pump 10. Preferably, controller 30 re-calculates $t_{wait}$ on a periodic basis to accommodate for changes in pump 10 that may effect its top speed.

After determining $t_{wait}$, controller 30 detects the trigger event ($p_{trigger}$ in FIG. 4) and waits $t_{wait}$ to signal opening of supply valve 32. As shown in FIG. 4, this signaling occurs before main valve 36 switches positions at $t_v$ to accommodate for the inherent delay. Thus, controller 30 anticipates the movement of main valve 36 before it actually occurs so that pressurized air is provided to main valve 36 at about the time it switches positions.

Because the delay is substantially reduced or eliminated, pressurized air is provided to main valve 36 at $t_v$ with little or no delay so that pressurized air is provided to diaphragm 22 or 24 with little or no delay. By reducing or eliminating the delay, speed of pump 10 increases to increase the output of pump 10. Additionally, the characteristic pressure drop indicating EOS may no longer be present. For example, as shown in FIG. 4, a pressure spike occurs at sensor 38 just before main valve 36 opens at tv rather than a pressure drop as shown in FIG. 2. To detect EOS based on the rapid pressure drop shown in FIG. 2, $t_{wait}$ may be increased so that the rapid pressure drop reappears. This may be necessary for periodically recalibrating the ideal $t_{wait}$ over the life of pump 10.

Controller 30 is also configured to determine the pump speed by observing pressure curve 52 of FIG. 4 (showing inherent delay compensation) or pressure curve 52 of FIG. 2 (showing no delay compensation). By monitoring cyclical events in pressure curves 52 such as EOS or other timing events, the pump speed of pump 10 can be determined. Controller 30 measures the time between each cyclical event ($t_{be}$) to determine the cycle time between each event. Because controller 30 will detect two events for each full cycle of pump 10 (one for first chamber 18 and one for second chamber 20), the cycle time will be twice $t_{be}$. The inverse of the cycle time ($2*t_{be}$) is the pump speed (cycles/unit of time).

By monitoring the pump speed, the fluid discharge rate ($Q_f$) of pump 10 can be determined. During each change of position of first and second diaphragms 22, 24, pump 10 discharges a volume of fluid equal to the expanded volume ($V_e$) of fluid side 40 of either first and second chambers 18, 20. $V_e$ is a known, relatively fixed value. Because controller 30 knows the pump speed based on the signal from pressure sensor 38, the rate of discharge $Q_f$ can be determined by $2*V_e*$the pump speed.

Controller 30 can be used to control $Q_f$ by adjusting the time between when cyclical characteristic (such as the EOS or other timing trigger) is detected and when supply valve 32 is opened. To maximize the pump speed, controller 30 provides no delay between when main valve 36 opens and pressurized air is provided to main valve 36 by supply valve 32. To reduce the output of pump 10, controller 30 provides a delay between when main valve 36 opens and pressurized air is provided to main valve 36 by supply valve 32. To decrease $Q_f$ and the pump speed, a longer delay is provided. To increase $Q_f$ and the pump speed, a shorter or no delay is provided. By adjusting $t_p$, controller 30 can also adjust $Q_f$.

Controller 30 is also configured to determine the air consumption of pump 10. By monitoring the pump speed and the pressure at EOS of diaphragms 22, 24, controller 30 can determine the mass flow rate of air used to operate pump 10. At the EOS, either air side 42 of first or second chamber 18, 20 is fully expanded with air. The fully expanded volume ($V_{ae}$) of the air side 42 and additional lines extending to supply valve 32 is a known, relatively fixed quantity. At the EOS, controller 30 knows the pressure ($P_{EOS}$) in the expanded air side 42. In FIG. 2, $P_{EOS}$ is equal to the pressure detected just before the rapid pressure drop. In FIG. 4, $P_{EOS}$ is substantially equal or slightly higher than the pressure detected just before the rapid increase caused by supply valve 32 providing pressurized air to main valve 36. Using the ideal gas law (PV=nRT), the mass of air ($m_a$) can be determined by $m_a=c*(P_{EOS}*V_{ae})/(R_a*T_a)$, where c is a constant for the compressed gas in use. $T_a$ is preprogrammed into controller 30 based on an average temperature of air normally provided to pump 10. According to an alternative embodiment, a temperature sensor (not shown) is provided to determine $T_a$ provided to pump 10. $R_a$ is the gas constant for air. Because controller 30 knows the pump speed based on the signal from pressure sensor 38, the mass flow rate of air ($Q_a$) can be determined by $2*m_a*$the pump speed.

As shown in FIG. 1, a user interface 54 may be provided that provides visual feedback to a user of the operational parameters of pump 10. Interface 54 may include an LCD screen 56 or other display that provides any combination of the pump operating parameters including, but not limited to, pump speed, instantaneous or accumulated mass air flow rates, pump fluid flow rates, the supply pressure, and the head pressure, Interface 54 also includes user inputs 58 that allow a user to control pump 10 by turning pump 10 on or off, adjusting $t_p$, or adjusting any of the other inputs to pump 10.

Depending on the specific design of housing 16, diaphragms 22, 24, the type of material being pumped, the preferred operating parameters of pump 10 may change. These parameters may include the pressure of the air supplied to pump 10, $t_p$, or $P_{EOS}$. Typically, if $P_{EOS}$ is greater than a preferred value, controller 30 is keeping supply valve 32 open too long providing an excess amount of air to air side 42. This excess air is then vented to atmosphere and the energy used to compress the excess air is wasted. If $P_{EOS}$ is lower than a preferred value, controller 30 is not keeping supply valve 32 open long enough so that there is not enough air to expand air side 42 of first pump chamber 18 completely or pump 10 may operate too slowly. Because controller 30 monitors $P_{EOS}$, it can decrease or increase $t_p$, as necessary to decrease or increase $P_{EOS}$. If the $P_{EOS}$ is above a determined maximum, controller 30 can lower $t_p$ to decrease $P_{EOS}$. If $P_{EOS}$ is below a determined minimum, controller 30 can increase $t_p$ to increase $P_{EOS}$. Similarly, if the supply pressure is too high, controller 30 can lower $t_p$ to decrease $P_{EOS}$. If the supply pressure is too low, controller 30 can increase $t_p$ to increase $P_{EOS}$.

In addition to monitoring $P_{EOS}$, controller 30 also monitors the pressure of air supply 28. As shown in FIGS. 2 and 4, the pressure in pump chambers 18, 20 generally plateaus at pressure $p_{pl}$ and time $t_{pl}$, while chambers 18, 20 are still exposed to air from air supply 28. The average air pressure during this plateau is generally equal to the air pressure provided by air supply 28. By monitoring the air pressure in chambers 18, 20 during the plateau, controller 30 determines the pressure of the air provided by air supply 28.

Controller 30 is also configured to operate pump 10 at its peak efficiency. By determining the fluid discharge rate from pump 10 and the air flow rate to the pump, controller 30 can determine the maximum efficiency of pump 10. During an efficiency test, controller 30 is configured to operate pump 10 over a range of $t_p$. For each $t_p$, controller 30 determines the pump efficiency, which is the average $Q_f$ over the tested time period divided by $Q_a$. Controller 30 records the efficiency for each $t_p$ and determines the $t_p$ associated with the peak efficiency. If pump 10 is set to operate at maximum efficiency, controller 30 opens and closes supply valve 32 for the $t_p$ associated with the peak efficiency.

Over time, the amount of pressure necessary to pump the fluid may increase. For example, if a filter (not shown) is provided upstream or downstream of pump 10, the filter will gradually clog. As the filter clogs, it becomes more difficult to pump the fluid. Thus, a longer $t_p$ is necessary to ensure there is enough pressure to expand air sides 42 of first and second diaphragms 18, 20 to the fully expanded positions.

Controller 30 is provided with an anti-stall algorithm to detect and compensate when air supply 28 provides too little air to fully expand air side 42 of either first and second chambers 18, 20. Controller 30 is programmed to include a stall time $t_s$. If $t_s$ passes from the time supply valve 32 opens without the EOS or the trigger event occurring, controller 30 provides another burst of air. If after repeated bursts of air, controller detects that the pressure in air side 42 of first chamber 16 never decays, the controller knows that pump 10 has stalled because first diaphragm 18 is no longer moving and expanding the volume of air side 42 of first chamber 16. Controller 30 then sends a notification that pump 10 has stalled and needs servicing. Such a notification could be provided to a central control center, on LCD display 54 of pump 10, or by any other known notification device or procedure known to those of ordinary skill in the art. Additional details of a suitable anti-stall algorithm are provided in U.S. patent application Ser. No. 10/991,296, filed Nov. 17, 2004, which was previously expressly incorporated by reference herein. According to one embodiment, if $t_s$ passes, controller 30 sends an alarm or notification that pump 10 has stalled without providing additional air from air supply 28. According to one embodiment of the present disclosure, controller 30 periodically tests pump 10 to determine the appropriate length of $t_p$ by using the anti-stall algorithm. Periodically, pump 10 gradually lowers $t_p$ until a stall event is detected by the anti-stall algorithm. Controller 30 then resets $t_p$ to a value slightly above the $t_p$ just before the stall event so that $t_p$ is just longer than required to avoid stalling. According to one embodiment, $t_p$ is set 10 ms above the $t_p$ that resulted in stalling. For example, $t_p$ could be set to 110 ms if 100 ms caused stalling.

The control system operating pump 10 can be provided on a wide variety of pumps, regardless of the pump manufacture. Many AOD pumps have common features. For example, many AOD pumps have valves or other devices that control switching of the air supply between the diaphragm chambers, such as valves 34, 36 of pump 10. Another common feature on AOD pumps is an air inlet, such as inlet 17, that receives pressurized air from an air supply.

As shown in FIG. 1, pressure sensor 38 and supply valve are positioned upstream of inlet 17 of housing 16. Controller 30 is coupled to these upstream components. Thus, pump 10 is controlled through inlet 17, a feature common to AOD pump. Because pump 10 is controlled through a common AOD pump feature, it can be used on almost any AOD pump by controlling the supply of air provided to the pump's inlet.

Figure 5:
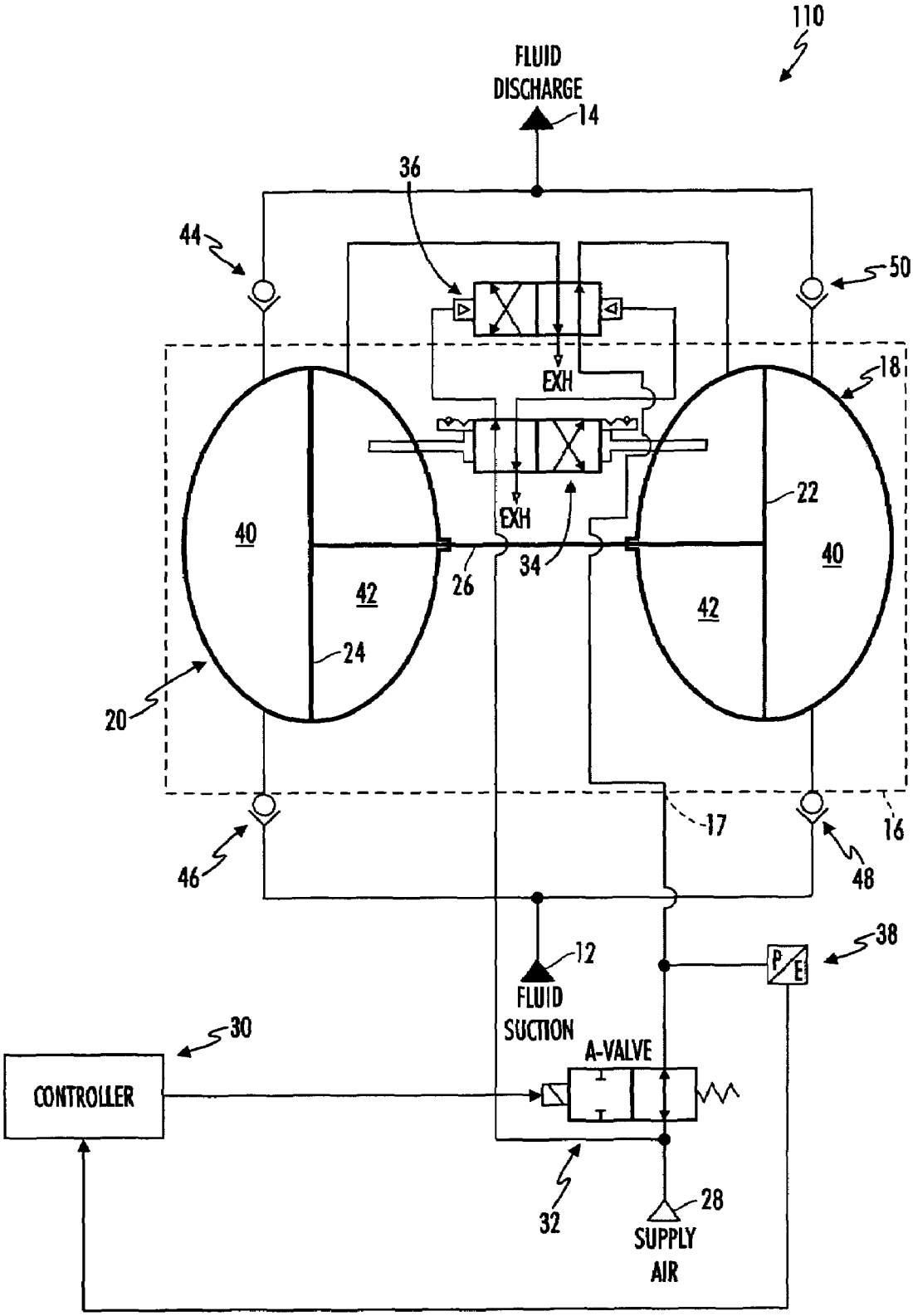
FIG. 5 is a view similar to FIG. 1 showing an alternative embodiment AOD pump.

Another alternative embodiment AOD pump 110 is shown in FIG. 5. AOD pump 110 is substantially similar to AOD pump 10. Pilot valve 34 is connected to air supply 28 upstream of control valve 32. When pilot valve 34 switches positions, it provides air to main valve 36 at the supply pressure provided by air supply 28. This increases the switching speed and reliability of main valve 36. Thus, $t_{mv}$ for pump 110 will be less than $t_{mv}$ for pump 10.

Figure 6:
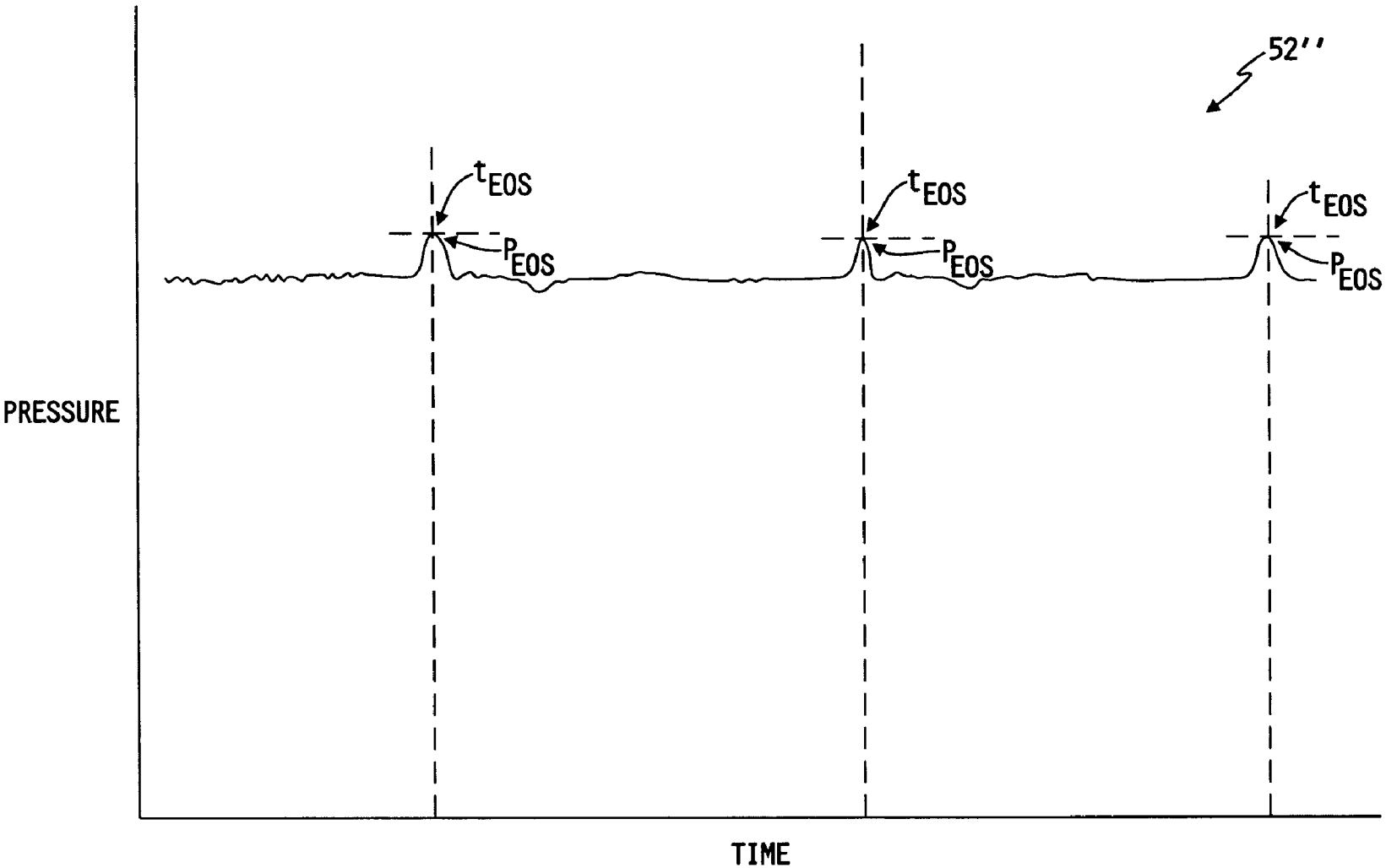
FIG. 6 is a graph of a pressure sensed by the pressure sensor during operation of the AOD pump when the control valve remains open or is not provided according to another embodiment of the present disclosure.

According to an alternative embodiment of the present disclosure, supply valve 32 remains open during cycling of pump 10 rather than opening just for short bursts or no supply valve 32 is provided. As shown in FIG. 6, a pressure curve 52" for this embodiment is substantially flat with a peak occurring at regular intervals at $t_{EOS}$ for first and second diaphragms 18, 20. As described above, the interval between peaks is used to determine the cycle time and pump operating speed. The peak pressure ($P_{EOS}$)may be used to determine the supply pressure. Using the cycle time and supply pressure (based on the peak pressure or provided otherwise), controller 30 can calculate the operational parameters of AOD pump 10 as described above. To enhance the pressure signal sensed by pressure sensor 38, a restriction, such as an orifice, may be provided between supply valve 32 and pressure sensor 38 or between air supply 28 and pressure sensor 38 if no supply valve 32 is provided. Because of the restriction provided by the orifice, air supply 28 provides less damping of the pressure signal sensed at by pressure sensor 38. If no orifice or other restriction is provided, inherent flow restrictions also dampen the influence of air supply 28 enough to also allow detection of the peaks that indicate EOS.

Although the invention has been described in detail with reference to certain preferred embodiments, variations and modifications exist within the spirit and scope of the invention as described and defined in the following claims.

The invention claimed is:

1. A pump including first and second diaphragm chambers, each diaphragm chamber including a diaphragm having a driven side, the diaphragms being coupled together, a pressure sensor positioned to detect a pressure associated with the driven side of at least one of the diaphragms and to output a signal indicative thereof, a controller configured to receive the signal from the pressure sensor and monitor a pressure to detect the position of at least one of the diaphragms, an air supply valve positioned to supply a flow of pressurized air for the first and second diaphragm chambers, the controller communicates with the air supply valve to control the flow of pressurized air based on the signal received from the pressure sensor, and a main valve in fluid communication with the air supply valve, wherein the main valve alternates between a first position supplying air to the first diaphragm chamber and a second position supplying air to the second diaphragm chamber.

2. The pump of claim 1, wherein the air supply valve supplies pressurized air to the main valve for a predetermined amount a time and blocks pressurized air from flowing to the main valve for another amount of time.

3. A pump including first and second diaphragm chambers, each diaphragm chamber including a diaphragm having a driven side, the diaphragms being coupled together by a connector for unitary movement in a cycle having a plurality of stages, each cycle including a designated stage, a pressure sensor positioned to detect a pressure associated with the driven side of at least one of the diaphragms and to output a signal indicative thereof, and a controller configured to receive the signal from the pressure sensor to detect when the cycle reaches the designated stage.

4. The pump of claim 3, further comprising an air supply valve positioned to control the supply of pressurized air from an air supply to the first and second diaphragm chambers.

5. The pump of claim 4, wherein the controller communicates with the air supply valve and provides pressurized air to the first and second diaphragm chambers for a predetermined time based on the controller detecting the designated stage and restricts pressurized air at other times.

6. The pump of claim 5, wherein the designated stage substantially corresponds to an end-of-stroke position of the first and second diaphragms.

7. The pump of claim 5, wherein the controller adjusts the length of the predetermined time based on a pressure sensed when the controller detects the designated stage.

8. The pump of claim 3, wherein the controller determines a cycle time of the cycle based on repetition of the designated stage.

9. The pump of claim 8, wherein the controller determines an air flow rate based on the cycle time.

10. The pump of claim 8, wherein the first and second diaphragms pump a fluid and the controller determines flow rate of the pumped fluid based on the cycle time.

11. The pump of claim 3, wherein the pressure sensor detects pressure in the first and second diaphragm chambers.

12. The pump of claim 3, further comprising an interface, wherein the controller provides a signal to the interface indicating an operating parameter of the pump based on the signal provided by the pressure sensor and the interface displays the operating parameter.

13. A pump including a housing, a pair of pump members coupled together by a connector and positioned to move in the housing in a cycle to pump material, a pressure sensor positioned to detect a pressure associated with a driven side of at least one of the pump members and to output a signal indicative thereof, a controller that receives the output signal and detects at least one parameter of the cycle, and an air supply valve providing air to the housing that is controlled by the controller based on detection of the at least one parameter.

14. The pump of claim 13, wherein the parameter detected by the controller is the cycle time of the cycle.

15. The pump of claim 13, wherein the parameter detected by the controller is a rate of pressure change in the interior region of the housing.

16. The pump of claim 13, wherein the detected parameter is a rate of pressure change in the interior region and the controller provides a control signal to open the air supply valve when the controller detects the rate of pressure change corresponds to a predetermined value.

17. The pump of claim 13, wherein the air supply valve is open for a predetermined time after receiving a control signal from the controller and then closes after the predetermined time.

18. The pump of claim 13, further comprising an interface, wherein the controller provides a signal to the interface indicating an operating parameter of the pump based on the signal provided by the pressure sensor and the interface displays the operating parameter.

19. A pump including first and second diaphragm chambers, each diaphragm chamber including a diaphragm, the diaphragms being coupled together, a main valve that alternates between a first position supplying air to the first diaphragm chamber and a second position supplying air to the second diaphragm chamber, a pressure sensor positioned to detect a pressure corresponding to movement of the main valve from at least the first position to the second position and to output a signal indicative thereof, and a controller configured to monitor the signal from the pressure sensor to detect a position of at least one of the diaphragms.

20. The pump of claim 19, further comprising an air supply valve positioned to provide air to the main valve, the controller communicates with the air supply valve to control the flow of air based on the signal received from the pressure sensor.

21. The pump of claim 20, wherein the air supply valve provides air to the main valve for a predetermined amount of time and restricts air from flowing to the main valve for another amount of time.

22. The pump of claim 21, wherein the controller adjusts the length of the predetermined time based on a pressure sensed when the controller detects the position of the at least one of the diaphragms.

23. The pump of claim 19, wherein the detected position of the at least one of the diaphragms is an end of stroke position.

24. The pump of claim 19, wherein the signal from the pressure sensor is a substantially cyclical pressure profile corresponding to movement of the diaphragms while pumping material.

25. The pump of claim 22, wherein the pressure profile includes a portion corresponding to an end of stroke position of the at least one of the diaphragms and the controller detects the portion to determine when the at least one of the diaphragms has reached the end of stroke position.

26. The pump of claim 19, wherein the controller monitors the signal from the pressure sensor to identify a rate of pressure change that indicates the position of the at least one of the diaphragms.

27. A pump including first and second diaphragm chambers, each diaphragm chamber including a diaphragm, the diaphragms being coupled together and operating in a cycle having a plurality of stages including a designated stage, a pilot valve positioned to alternate between a first position and a second position in response to the cyclical operation of the diaphragms, a pressure sensor positioned to detect a pressure corresponding to movement of the pilot valve from at least the first position to the second position and to output a signal indicative thereof, and a controller configured to receive the signal from the pressure sensor to detect when the cycle reaches the designated stage.

28. A pump including first and second diaphragm chambers, each diaphragm chamber including a diaphragm, the diaphragms being coupled together, a pressure sensor positioned to detect a pressure in at least one of the first and second diaphragm chambers and to output a signal indicative thereof, a controller configured to receive the signal from the pressure sensor and monitor a pressure to detect the position of at least one of the diaphragms, an air supply valve positioned to supply a flow of pressurized air for the first and second diaphragm chambers, the controller communicating with the air supply valve to control the flow of pressurized air based on the signal received from the pressure sensor, and a main valve in fluid communication with the air supply valve, wherein the main valve alternates between a first position supplying air to the first diaphragm chamber and a second position supplying air to the second diaphragm chamber.

29. A pump including first and second diaphragm chambers, each diaphragm chamber including a diaphragm, the diaphragms being coupled together, a pressure sensor positioned to detect a pressure in at least one of the first and second diaphragm chambers and to output a signal indicative thereof, a controller configured to receive the signal from the pressure sensor and monitor a pressure to detect the position of at least one of the diaphragms, an air supply valve positioned to control the flow of pressurized air to the first and second diaphragm chambers, the controller communicating with the air supply valve to control the flow of pressurized air based on the signal received from the pressure sensor, and a main valve in fluid communication with the air supply valve, the main valve alternating between a first position supplying air to the first diaphragm chamber and a second position supplying air to the second diaphragm chamber, wherein the air supply valve supplies pressurized air to the main valve for a predetermined amount of time and blocks pressurized air from flowing to the main valve for another amount of time.

30. A pump including first and second diaphragm chambers, each diaphragm chamber including a diaphragm, the diaphragms being coupled together by a connector for movement through a cycle of operation including a designated stage, a pressure sensor positioned to output a signal indicative of a pressure in at least one of the chambers, an air supply valve coupled to an air supply, and a controller configured to receive the signal from the pressure sensor to detect when the cycle reaches the designated stage, the controller causing the air supply valve to provide air to the chambers for a predetermined time upon detecting the designated stage and to restrict the supply of air at other times.

31. A pump including first and second diaphragm chambers, each diaphragm chamber including a diaphragm, the diaphragms being coupled together by a connector for movement through a cycle of operation including a designated stage, a pressure sensor positioned to output a signal indicative of a pressure in at least one of the chambers, and a controller configured to receive the signal from the pressure sensor to determine a cycle time of the cycle of operation based upon repetition of the designated stage.

* * * * *